US010475613B2

(12) United States Patent
Martin

(10) Patent No.: US 10,475,613 B2
(45) Date of Patent: Nov. 12, 2019

(54) TRIP FOR ELECTRICAL SWITCHING DEVICE AND ELECTRICAL SWITCHING DEVICE COMPRISING SUCH A TRIP

(71) Applicant: Schneider Electric Industries SAS, Rueil Malmaison (FR)

(72) Inventor: Willy Martin, Vaulenaveys le Haut (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 374 days.

(21) Appl. No.: 14/933,444

(22) Filed: Nov. 5, 2015

(65) Prior Publication Data

US 2016/0133421 A1 May 12, 2016

(30) Foreign Application Priority Data

Nov. 10, 2014 (FR) ..... 14 60843

(51) Int. Cl.

| | |
|---|---|
| ***H01H 71/12*** | (2006.01) |
| ***H01H 71/02*** | (2006.01) |
| ***H01H 45/02*** | (2006.01) |
| ***H01H 47/22*** | (2006.01) |

(52) U.S. Cl.

CPC ..... *H01H 71/125* (2013.01); *H01H 45/02* (2013.01); *H01H 47/22* (2013.01); *H01H 71/0228* (2013.01); *H01H 71/12* (2013.01); *H01H 2071/0242* (2013.01)

(58) Field of Classification Search

CPC ..... H01H 71/12

USPC ..... 200/50.1–50.4, 50.01; 307/112

See application file for complete search history.

(56) References Cited

U.S. PATENT DOCUMENTS

| | | | | |
|---|---|---|---|---|
| 3,932,716 A * | 1/1976 | Mottel | H01H 9/20 200/50.02 |
| 4,673,779 A | 6/1987 | Bohnen et al. | |
| 5,055,703 A * | 10/1991 | Schornack | H02J 9/062 307/64 |
| RE35,190 E * | 3/1996 | Zylstra | G05F 1/56 361/640 |
| 5,877,691 A | 3/1999 | Suptitz et al. | |

(Continued)

FOREIGN PATENT DOCUMENTS

| | | |
|---|---|---|
| EP | 0 843 332 A1 | 5/1998 |
| FR | 2 703 506 A1 | 10/1994 |

OTHER PUBLICATIONS

French Preliminary Search Report dated Jul. 7, 2015 in French Application 14 60843, filed on Nov. 10, 2014 (with English Translation of Categories of Cited Documents).

*Primary Examiner* — Adi Amrany

(74) *Attorney, Agent, or Firm* — Oblon, McClelland, Maier & Neustadt, L.L.P.

(57) ABSTRACT

A trip for electrical switching device including a protective housing, first electrical connection terminals, and a supply module including at least one transformer and second input and output terminals able to be connected to the first connection terminals according to a direction of connection. The supply module is able to generate a supply voltage on the basis of an input voltage received between the second input terminals and to deliver the supply voltage between the second output terminals. The supply module is movable with respect to the protective housing.

18 Claims, 6 Drawing Sheets

(56) References Cited

U.S. PATENT DOCUMENTS

| | | | | |
|---|---|---|---|---|
| 6,647,197 | B1 * | 11/2003 | Marrs | G02B 6/4455 385/134 |
| 7,159,283 | B2 * | 1/2007 | Chang | F16B 2/10 24/457 |
| 8,811,026 | B2 * | 8/2014 | Engelvin | H05K 7/1409 361/759 |
| 2004/0090723 | A1 * | 5/2004 | Mason | H02H 1/06 361/42 |
| 2005/0136715 | A1 * | 6/2005 | Schlack | H05K 7/1409 439/160 |
| 2009/0142970 | A1 * | 6/2009 | Patel | H01R 13/514 439/712 |
| 2012/0320479 | A1 * | 12/2012 | Ohtsuka | B23B 45/02 361/87 |
| 2015/0364272 | A1 * | 12/2015 | Dankert | H01H 71/125 361/115 |
| 2015/0382508 | A1 * | 12/2015 | Tatta | H05K 7/20409 361/716 |

* cited by examiner

TRIP FOR ELECTRICAL SWITCHING DEVICE AND ELECTRICAL SWITCHING DEVICE COMPRISING SUCH A TRIP

The present invention relates to a trip for an electrical switching device. The trip comprises a protective housing and first electrical connection terminals. The trip further comprises a supply module comprising at least one transformer, and second input and output terminals able to be connected to the first terminals according to a direction of connection. The supply module is able to generate a supply voltage on the basis of an input voltage received between the second input terminals, and to deliver the supply voltage between the second output terminals.

The present invention also relates to an electrical switching device, such as a circuit breaker, comprising such a trip.

Document EP 0 843 332 A1 discloses an electrical-current switching device, the switching device comprising a trip. The trip is connected to current sensors and controls the electrical switching of the device on the basis of information supplied by the current sensors. This trip comprises a dedicated power supply module, powered by the voltage at the input to the switching device and generating a trip supply voltage. Such a supply module is known as an input-voltage powered supply. It allows the trip to be powered without connection to an auxiliary power supply and operates even when the switching device is blocking the passage of current.

However, such an input-voltage powered supply is vulnerable and may be damaged under certain operating conditions. In particular, during certain electrical tests such as, for example, those defined in the IEC 60 947-2 standard and the IEC 61 439-1 standard, the input-voltage powered supply is likely to give rise to a dielectric fault. A fault of this type may therefore lead to the input-voltage powered supply being destroyed, and in such cases the trip generally then needs to be fully replaced.

It is an object of the invention to propose a trip provided with an input-voltage powered supply that allows the supply module to be easily electrically disconnected and kept safe while electrical tests are being carried out.

To this end, one subject of the invention is a trip of the abovementioned type, in which the supply module is moveable with respect to the protective housing.

According to other advantageous aspects of the invention, the trip comprises one or more of the following features, considered in isolation or in any technically feasible combination:

- the supply module is translationally moveable with respect to the protective housing in the direction of connection;
- the supply module is removable with respect to the protective housing;
- the supply module is moveable between a connected position in which the second terminals are connected to the first terminals and at least one disconnected position in which the second terminals are disconnected from the first connection terminals;
- the trip further comprises means of keeping the supply module in at least one disconnected position;
- the trip further comprises latching means moveable between a latching position in which the supply module is blocked in the connected position and an unlatched position allowing the supply module to move out of the connected position;

- the supply module further comprises control elements configured to move the latching means between their latched position and their unlatched position;
- the control elements are secured to a grippable member configured to be grasped by an operator; and
- the trip further comprises stop means moveable between a stop position preventing the supply module from being withdrawn from the protective housing and a free position allowing the supply module to be withdrawn from the protective housing.

Another subject of the invention is an electrical switching device, such as a circuit breaker, comprising a trip as defined hereinabove.

According to another advantageous aspect of the invention, the electrical switching device comprises the following features:

- the trip comprises stop means moveable between a stop position preventing the supply module from being withdrawn from the protective housing and a free position allowing the supply module to be withdrawn from the protective housing, and the electrical switching device further comprises a base and a protective cap fixed removably to the base, the cap, when fixed to the base, covering the stop means so as to prevent access thereto from outside the cap.

These features and advantages of the invention will become apparent from reading the following description given solely by way of nonlimiting example and given with reference to the attached drawings in which:

FIG. 1 is an exploded view of a switching device, such as a circuit breaker, comprising a protective case and a trip according to one embodiment of the invention; the trip comprising a protective housing, first connection terminals and a supply module that is moveable with respect to the protective case between a connected position and at least one disconnected position, the trip further comprising means for keeping the module in a first disconnected position, means for latching the module in the connected position and stop means able to prevent the module from being withdrawn, the supply module being in the connected position in FIG. 1;

Figure 1:
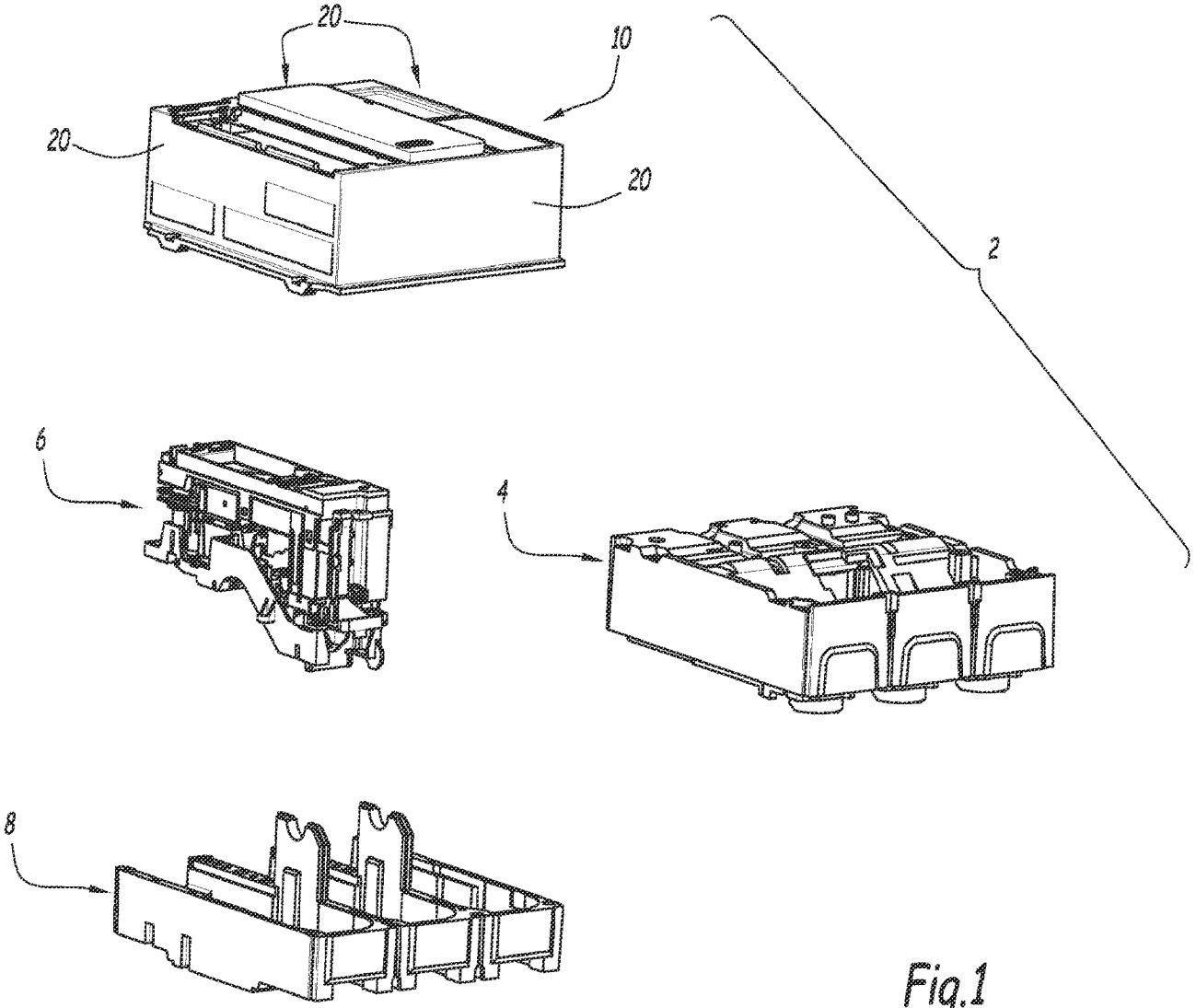

FIG. 1 is an exploded view of an electrical switching device 2 according to the invention. The switching device 2 is, for example, a circuit breaker, such as an electromechanical circuit breaker, or alternatively a switch. The circuit breaker is, for example, a three-phase circuit breaker as depicted in FIG. 1.

In FIG. 1, the electrical switching device 2 comprises several modules distinct from one another, including in particular a circuit breaker unit 4 and a trip 6. As an optional addition, the switching device 2 comprises other modules, such as calibration modules able to measure the performance of the switching device, or communication modules able to communicate the state of the device 2 to other remote electronic devices, communication being, for example, via radiowave.

The switching device 2 also comprises a base 8 and a cap 10.

The circuit breaker unit 4 comprises primary connection terminals (not depicted) intended to be connected to at least one input conductor and at least one output conductor (neither depicted).

The circuit breaker unit 4 is able to accept the trip 6. The circuit breaker unit 4 is able to receive at least one current I on an input conductor.

The circuit breaker unit 4 is known per se and is able to cut the transmission of current I from an input conductor to an output conductor in response to a trip signal.

The circuit breaker unit 4 is, for example, an air circuit breaker or a moulded-case circuit breaker. In FIG. 1, the circuit breaker unit 4 is a three-pole unit comprising one pole for each of the phases associated with the three-phase breaker.

Figure 2:
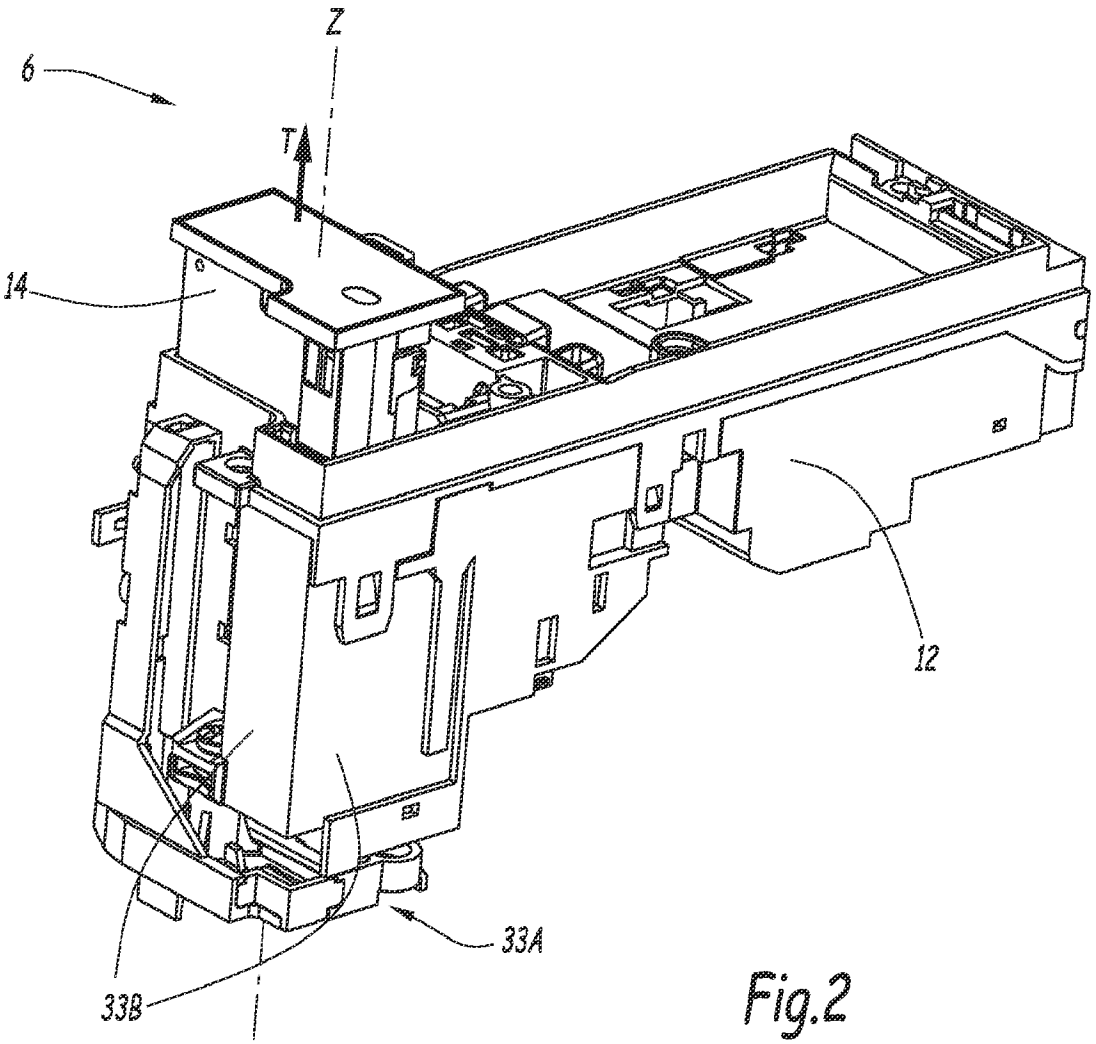
FIG. 2 is a perspective view of the trip of FIG. 1, the supply module being in the first disconnected position.
Figure 3:
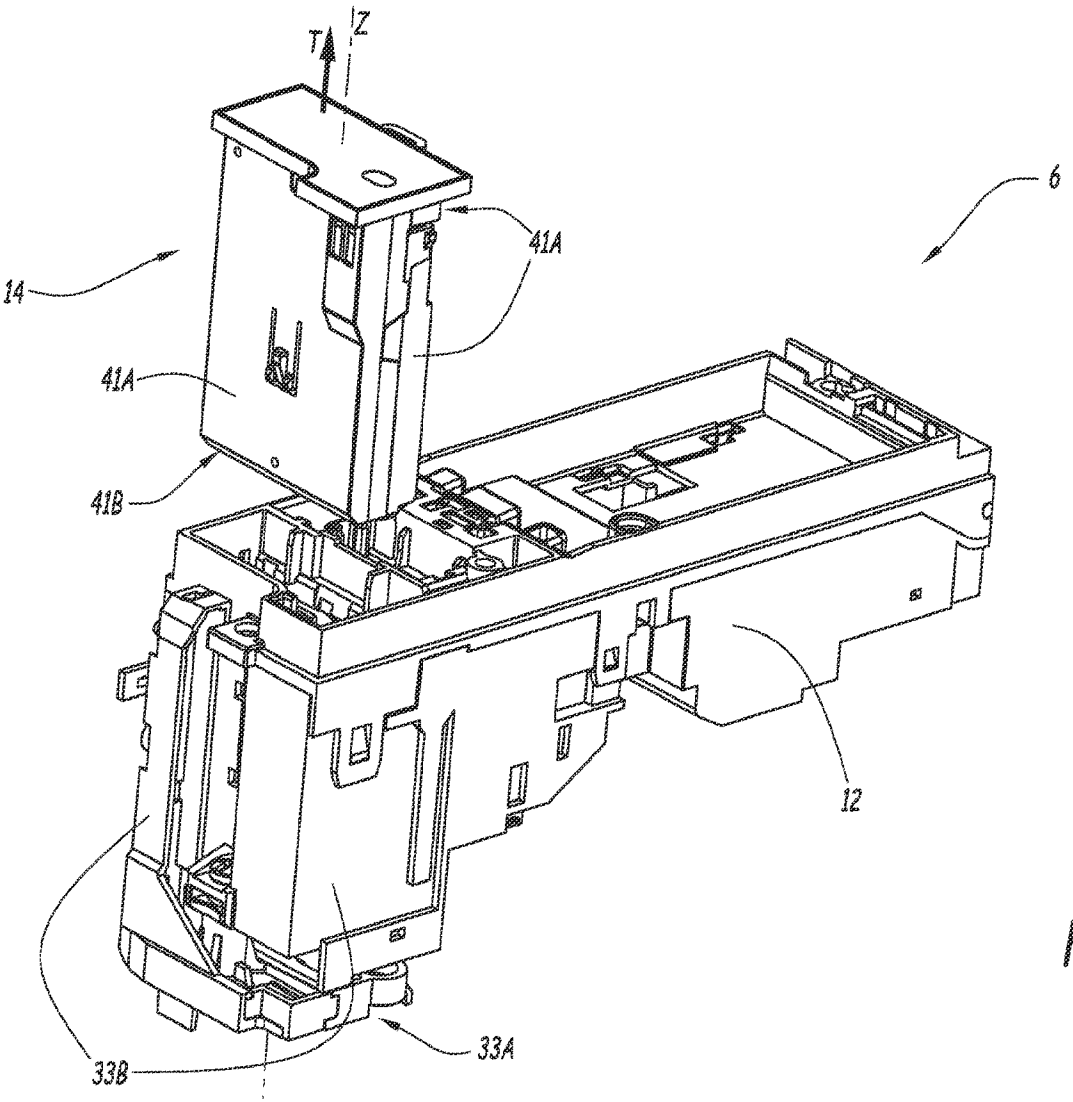
FIG. 3 is a perspective view of the trip of FIG. 1, the supply module being completely extracted from the protective housing, corresponding to a second disconnected position.

In FIGS. 2 and 3, the trip 6 comprises a protective housing 12, a supply module 14, a space 16 for receiving the supply module 14 and first secondary connection terminals (which have not been depicted). The supply module 14 is moveable with respect to the protective housing 12 between a connected position in which the said module 14 is electrically connected to the trip 6 and at least one disconnected position in which the said module 14 is not electrically connected to the trip 6.

Figure 6:
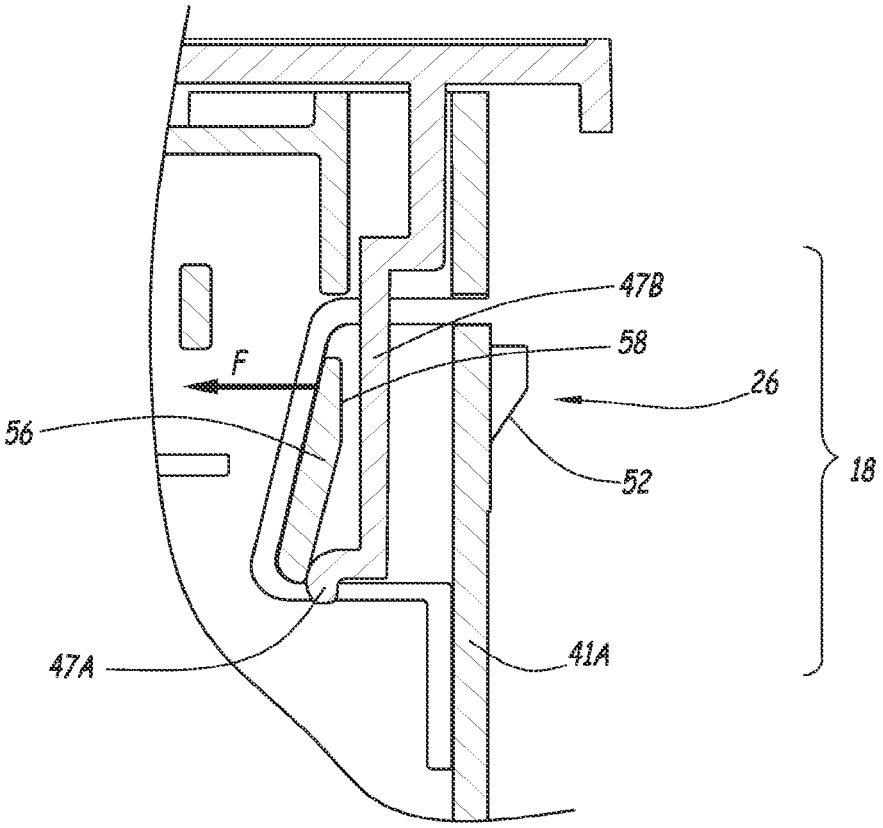
FIG. 6 is a partial and perspective view of the latching means and of the control elements of FIG. 4.
Figure 7:
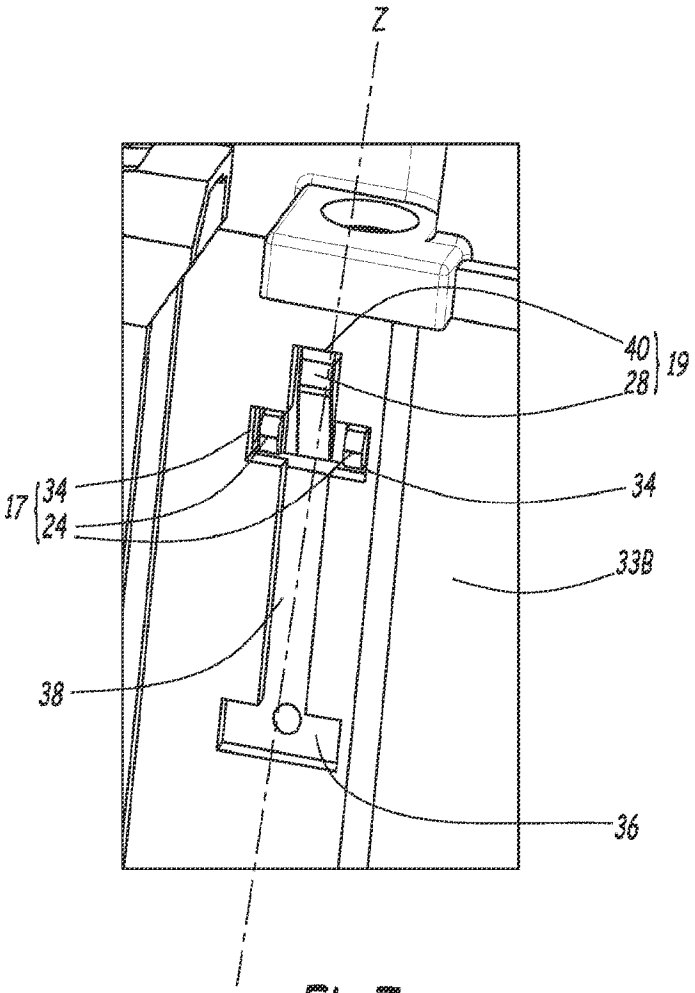
FIG. 7 is a partial and perspective view of the trip of FIG. 1, with the supply module in the first disconnected position.

The trip 6 further comprises means 17 for keeping the module in at least one disconnected position, means 18 for latching the module in the connected position and stop means 19 able to prevent the supply module 14 from being withdrawn from the housing 12, as depicted in FIGS. 6 and 7.

The trip 6 is able to generate a trip signal from a measurement of the current I. For example, the trip 6 comprises a current sensor, not depicted, able to generate a signal indicative of the measurement of the current I. The trip 6 is then able to deliver the generated trip signal bound for the circuit breaker unit 4.

The base 8, visible in FIG. 1, is able to receive the circuit breaker unit 4 to form a circuit breaker assembly.

The cap 10 is parallelepipedal and comprises four lateral walls 20. The cap 10 is fixed removably to the circuit breaker unit 4 to form a protective case. The cap 10 is able to at least partially cover the trip 6 when it is fixed to the circuit breaker unit 4. The cap 10 is preferably able to allow partial access to the supply module 14 when the cap 10 is fixed to the circuit breaker unit 4.

Figure 4:
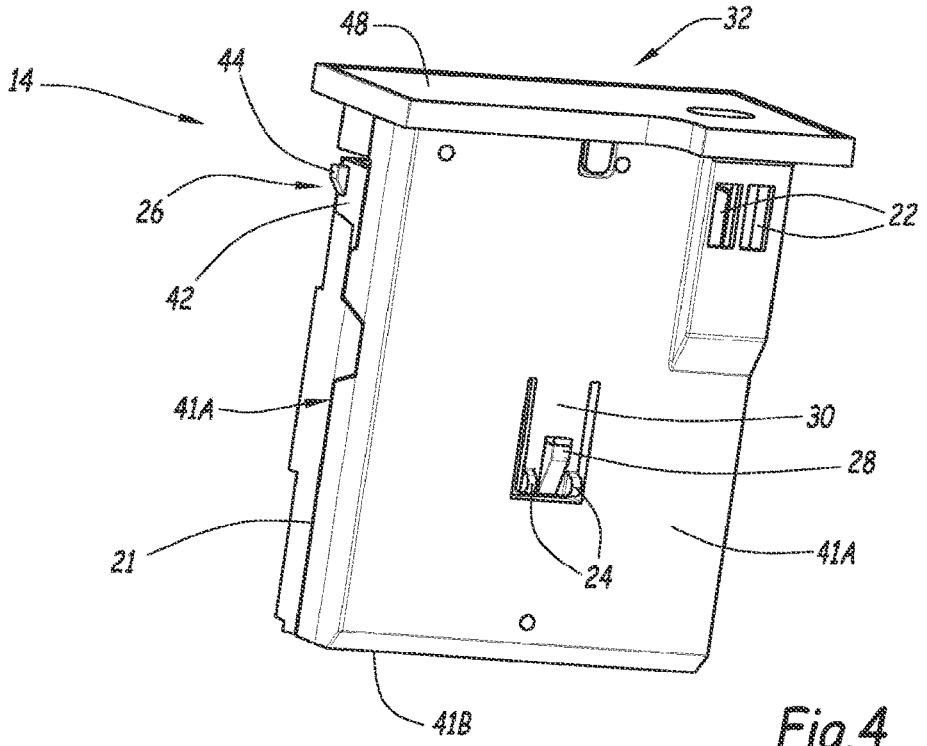
FIG. 4 is a perspective view of the supply module of FIG. 1, the module comprising a protective shell and second connection terminals.

In FIG. 4, the supply module 14 comprises a shell 21, second secondary connection terminals 22 able to collaborate with the first secondary terminals, the second secondary terminals comprising second secondary input terminals and second secondary output terminals.

The supply module 14 is moveable in a direction of connection between the connected position in which the second secondary terminals 22 are connected to the first secondary terminals and one of the disconnected position(s) in which the second secondary terminals 22 are disconnected from the first secondary terminals.

The supply module 14 is preferably translationally moveable in the direction of connection, which corresponds for example to a vertical direction Z in the space 16.

The supply module 14 is preferably removable with respect to the protective housing 12. In other words, the supply module 14 is fully extractable from the protective housing 12. In that case, the supply module 14 is moveable with respect to the protective housing 12 between the connected position, a first disconnected position in which the second secondary terminals 22 are disconnected from the first secondary terminals (FIG. 2), and a second disconnected position in which the supply module 14 is no longer in contact with the protective housing 12 (FIG. 3).

The supply module 14 further comprises projections 24 for keeping the supply module 14 in the first disconnected position, members 26 for latching the supply module 14 in the connected position and a stop projection 28 able to prevent movement of the supply module 14 from the first disconnected position to the second disconnected position unless transverse pressure is externally applied to the said stop projection 28. In the example of FIG. 4, the retaining projections 24 and the stop projection 28 are borne by an elastic tab 30.

The supply module further comprises control elements 31 configured to move the latching means 18 between their latched position and their unlatched position.

The supply module 14 also comprises a grip 32, the grip 32 preferably being secured to the control elements 31.

The supply module 14 also comprises a conversion circuit (not depicted) able to generate a converted voltage from an input voltage. The supply module 14 is able to receive the input voltage between the second secondary input terminals. The supply module is able to deliver the converted voltage between the second secondary output terminals.

The space 16 is bounded by a lower wall 33A and four lateral walls 33B. The lateral walls 33B are, for example, rectangular.

The space 16 comprises a first opening 34 for keeping the module in the first disconnected position. The first opening 34 is able to collaborate with the retaining projections 24 by clip-fastening and is, for example, formed in a corresponding lateral wall 33B, as depicted in FIG. 7.

Figure 8:
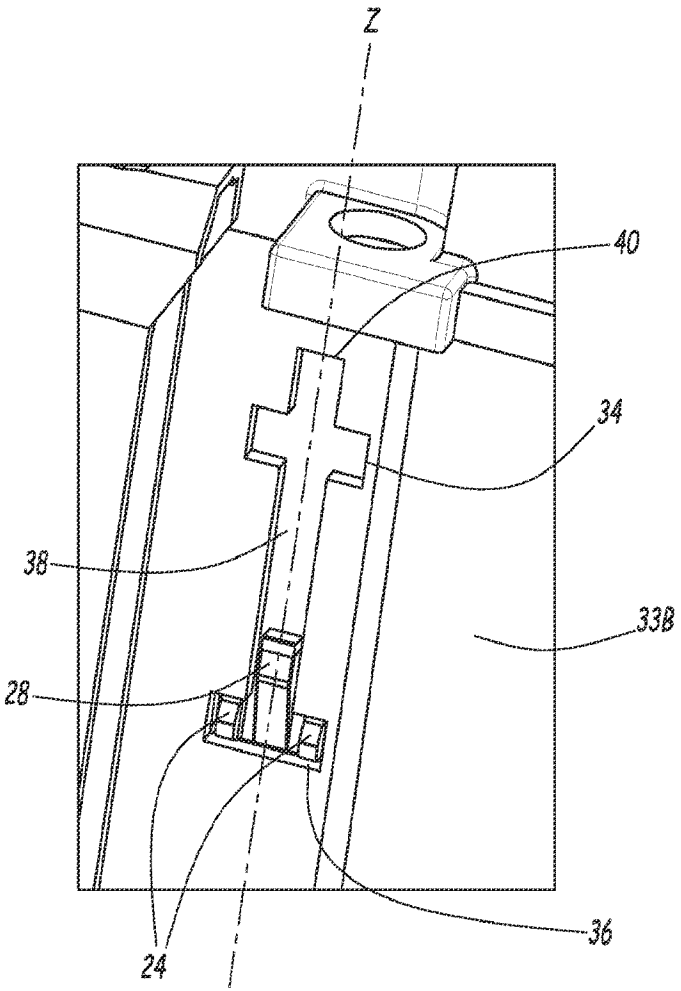
FIG. 8 is a partial and perspective view of the trip of FIG. 1 with the supply module in the connected position in which the second terminals are connected to the first terminals.

The space 16 comprises a second opening 36 able to collaborate with the retaining projections 24 by clip-fastening, when the supply module 14 is in the connected position, and is formed for example in a corresponding lateral wall 33B, as depicted in FIG. 8.

The space 16 comprises members 37 for blocking the supply module 14 in the connected position. The blocking members 37 are able to collaborate with latching members 26 to block the supply module 14 in the connected position. Each blocking member 37 is, for example, in the form of a cavity formed in a corresponding lateral wall 33B of the space 16. As an alternative that has not been depicted, each blocking member 37 is in the form of a blocking relief projecting from a corresponding lateral wall of the space 16.

The space 16 comprises a vertical slot 38 able to receive the stop projection 28. The slot 38 is, for example, an opening formed in the corresponding lateral wall 33B. The slot 38 comprises an end stop 40 able to collaborate with the stop projection 28 to prevent the supply module 14 from moving from the first disconnected position to the second disconnected position unless transverse pressure is applied externally to the said stop projection 28.

The first secondary connection terminals lie flush on a lateral wall 33B of the space housing the supply module 14.

The retaining means 17 are able to keep the supply module 14 in the first disconnected position. The retaining means 17 are, for example, elastic retaining means. In FIG. 7, the retaining means 17 comprise the first opening 34 and the retaining projections 24 are able to collaborate with the first opening 34.

As an alternative that has not been depicted, the retaining means 17 are magnetic retaining means and for example comprise a permanent magnet secured to the supply module 14 and a first ferromagnetic member secured to the protective housing 12, the permanent magnet being designed to apply a force of magnetic attraction to the first ferromagnetic member when it faces the latter. The permanent magnet is, for example, housed in a cavity formed in the shell 21, and the first ferromagnetic member is similarly housed in a cavity formed in the protective housing 12, the respective positions of the permanent magnet and of the first ferromagnetic member being such that the permanent magnet and the first ferromagnetic member face one another when the supply module 14 is in the first disconnected position.

The latching means 18 are, for example, elastic latching means. In FIG. 6, the latching means 18 comprise the blocking members 37 borne by the housing space 16 and latching members 26 borne by the supply module 14.

In an alternative form that has not been depicted, the latching means 18 are magnetic latching means and comprise for example the permanent magnet secured to the supply module 14 and a second ferromagnetic member secured to the protective housing 12, the permanent magnet being designed to apply a force of magnetic attraction to the second ferromagnetic member when it is facing the latter. The second ferromagnetic member is, for example, housed in a corresponding cavity formed in the protective housing 12, and the respective positions of the permanent magnet and of the second ferromagnetic member are such that the permanent magnet and the second ferromagnetic member face one another when the supply module 14 is in the connected position.

The stop means 19 are, for example, elastic stop means. In FIG. 7, the stop means 19 comprise the stop projection 28 and the end stop 40 able to collaborate with the stop projection 28.

Figure 5:
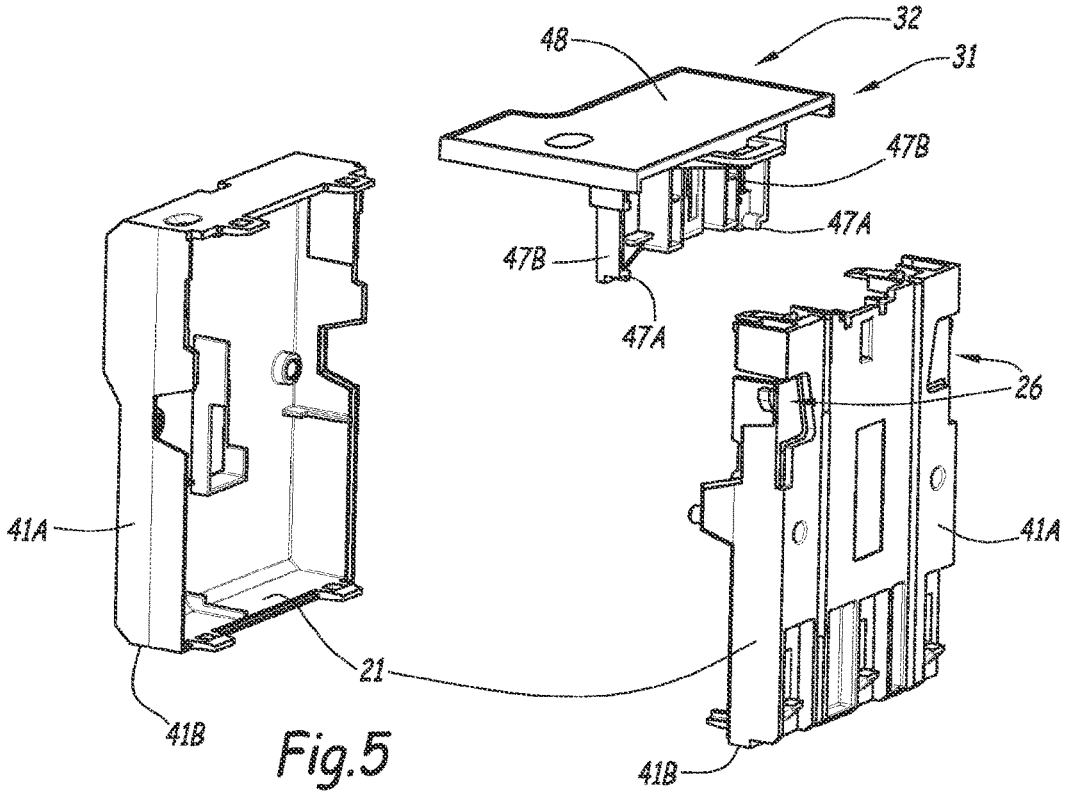
FIG. 5 is an exploded view of the supply module of FIG. 4, the supply module comprising a conversion circuit and a grip equipped with elements for controlling the latching means.

The protective shell 21 is, for example, in the form of a rectangular parallelepiped. The protective shell 21 comprises four lateral faces 41A and a lower face 41B. The lateral faces 41A are, for example, rectangular. In FIG. 5, the protective shell 21 is made up of two distinct parts.

The second secondary connection terminals 22 are electrically connected to the conversion circuit. The second secondary connection terminals 22 are able to be connected to the first secondary connection terminals when the supply module 14 is in the connected position.

The conversion circuit comprises at least one voltage transformer, not depicted. The conversion circuit comprises for example an AC/DC converter or, as an alternative, a DC/AC converter.

The latching members 26 are moveable between a latched position and an unlatched position. In the latched position, the latching members 26 are able to collaborate with the blocking members 37 to block the supply module 14 in the connected position. In the unlatched position, the latching members 26 are configured to allow the supply module 14 to move out of the connected position. In FIGS. 4 and 6, the latching members 26 comprise two flexible portions 42, each one equipped with a latching projection 44 and with complementary control means 46 able to collaborate with the control elements 31.

In FIG. 4, the elastic tab 30 is formed as one with the protective shell 21. The tab 30 is able to deform towards the inside of the protective shell 21 under the action of a force that is greater than the weight of the supply module 14.

The control elements 31 comprise at least one actuating stud 47A configured to collaborate with the complementary control means 46 and at least one vertical flank 47B connecting the corresponding actuating stud 47A to the grip 32, as depicted in FIG. 6. In the embodiment of FIG. 5, the control elements 31 comprise two actuating studs 47A and two vertical flanks 47B connecting the actuating studs to the grip 32. Each actuating stud 47A is configured to act on a corresponding flexible portion 42.

In FIG. 5, the grip 32 comprises an upper plate 48. The upper plate 48 is secured to each vertical flank 47B and each vertical flank 47B is for example formed as one with the upper plate 48. The upper plate 48 and the control elements 31 are translationally moveable in the direction of connection Z with respect to the protective shell 21.

The vertical slot 38 is able to allow vertical translation of the stop projection 28. The vertical slot 38 is dimensioned so that the stop projection 28 comes into contact with the end stop 40 when the supply module 14 is in the first disconnected position. In a preferred embodiment, the vertical slot 38 is able to be covered by the cap 10 when it is fixed to the circuit breaker unit 4.

The end stop 40 is situated at the upper end of the vertical slot 38.

In FIG. 6, the latching projection 44 comprises an inclined surface 52 able to facilitate movement of the supply module 14 from one of the disconnected positions towards the connected position.

The latching projection 44 is able to prevent the supply module 14 from moving out of the connected position when the latching means 18 are in the latched position. In FIG. 6, the latching projection 44 comprises a blocking surface 54 able to collaborate with the blocking member 37. The blocking surface 54 is preferably substantially perpendicular to the direction of connection Z.

The complementary control means 46 comprise, for each flexible portion 42, a cam surface 56 able to collaborate with a corresponding actuating stud 47A to move the corresponding latching projection 44 towards the inside of the supply module 14, which means to say to cause the latching means 18 to move from their latched position into their unlatched position. The cam surface 56 forms an angle lying strictly between 0° and 90° to the lateral face 41A of the shell, which means to say to the vertical direction Z, the angle preferably being between 10 and 50°.

The complementary control means 46 comprise, for each flexible portion 42, a surface 58 for stabilizing the latching projection 44 away from the corresponding blocking member 37. Each stabilizing surface 58 is configured to keep the latching means 18 in their unlatched position after an operator has grasped the grip 32. Each stabilizing surface 58 is substantially parallel to the lateral face 41A of the shell, namely to the vertical direction Z. Each stabilizing surface 58 is able to rotate by a few degrees about a direction perpendicular to the vertical direction Z as the latching means 18 pass from their latched position into their unlatched position.

The flexible portion 42 is for example formed as one with the protective shell 21. The flexible portion 42 is able to deform towards the inside of the protective shell 21, under the action of a force F, visible in FIG. 6.

In the embodiment of FIGS. 1 to 8, the module, which is moveable, preferably translationally, with respect to the protective case 12 is the supply module 14. A person skilled in the art will therefore appreciate that the invention can be applied more generally to any module of the trip 6 and that the means 17 maintaining at least one disconnected position are, as an alternative or in addition, associated with any type of module included within the trip 6. Similarly, the stop means 19 and/or the latching means 18 are, as an alternative or in addition, associated with any type of module included within the trip 6 and moveable with respect to the protective housing 12.

Thus, the supply module 14 is translationally moveable with respect to the protective housing 12 of the trip in a direction of connection. The supply module 14 is moveable between a connected position and a first disconnected position. The latching means 18 are, by default, i.e. when the grip 32 is not being manipulated, able to block the supply module 14 in the connected position. In other words, when the supply module 14 is in the connected position and the latching means 18 are in the latched position, the latching means 18 prevent the supply module 14 from moving out of the latched position as long as the grip 32 is not being manipulated.

The elasticity of the flexible portion 42 ensures that the latching means 18 are kept in their latched position in the absence of action on the grip 32.

The movement of the latching means 18 from their latched position into their unlatched position is obtained by action on the grip 32. The translational movement of the grip 32 with respect to the shell 21 causes the actuating studs 47A to move in the direction of connection. Because of the cam surface 56, the actuating studs 47A cause the flexible portion 42 of the latching means 18, notably the latching projections 44, to rotate towards the inside of the shell 21. The latching means 18 therefore move into their unlatched position and the continuing upwards pull on the grip 32 then causes an at least partial extraction of the supply module 14 from the protective housing 12, namely a movement of the supply module 14 from its connected position into one of its disconnected positions by applying to the grip 32 a pulling force T in the direction of connection Z visible in FIGS. 2 and 3.

The movement of the supply module 14 with respect to the housing 12 and the movement of the grip 32 with respect to the shell 21 are translational movements in the direction of connection Z.

A pull on the grip 32 therefore makes it possible both to unlatch the supply module 14 and to move the supply module 14 out of the connected position. In addition, the choice of such a translational movement of the supply module 14 with respect to the housing 12 allows the use of retaining means 17 that are simple, such as elastic retaining means, for example clip-fastening retaining means or even magnetic retaining means.

In the example of FIG. 7, the supply module 14 is held in the first disconnected position by the clip-fastening of the retaining projections 24 into the first opening 34. In other words, collaboration of the retaining projections 24 by clip-fastening with the first opening 34 provides a retaining force greater than the weight of the supply module 14 and that opposes the said weight of the supply module 14 in the vertical direction Z.

The flexibility of the elastic tab 30 allows it to deform towards the inside of the shell 21 when a force greater than the retaining force is applied. Application in the direction of connection of a force greater than the retaining force, which is itself greater than the weight of the supply module 14, then causes the supply module 14 to move from the first disconnected position into the connected position.

According to FIG. 8, when the supply module 14 is in the connected position, the retaining projections 24 are clipped into the bottom opening 36, and the tab 30 is therefore in its rest position. The clipping of the retaining projections 24 into the bottom opening 36 allows the stop projection 28 to position away from the lateral wall 33B and thus limits deformation of the tab 30 in this position. The flexibility of the elastic tab 30 allows the tab 30 to deform towards the inside of the shell 21 under the action of a force greater than the weight of the module. Therefore, if an operator applies a force greater than the weight of the supply module 14 in the direction of connection, the operator can force the supply module 14 to move from the connected position into the first disconnected position when the latching means 18 are in their unlatched position.

When the supply module 14 is in the first disconnected position, the stop projection 28 is resting against the end stop 40 of the vertical slot 38. The stop projection 28 therefore prevents the supply module 14 from moving towards the outside of the housing 12. Nevertheless, the flexibility of the tab 30 allows an operator to force the tab 30 to move towards the inside of the shell 21, for example using a tool, such as a screwdriver, for the purposes of completely extracting the supply module 14 from the housing 12. The operator then disengages the stop projection 28 with respect to the end stop 40.

According to a preferred embodiment, the cap 10 completely covers the slot 38 when it is fixed to the circuit breaker unit 4. It is therefore necessary to remove the cap 10 in order to be able to disengage the stop projection 28 from the end stop 40 and therefore in order to be able to extract the supply module 14 completely with respect to the housing 12.

In the example of FIG. 1, the cap 10 comprises an opening facing the grip 32 and therefore does not cover the grip 32 when fixed to the circuit breaker unit 4. The cap 10 therefore allows an operator to act directly on the grip 32, without the need to remove the cap 10, so as to move the supply module 14 between its connected position and its first disconnected position. The operator can thus easily electrically disconnect the supply module 14, for example to carry out tests, without removing the cap 10 in order to do so.

The translational movement allows easy disconnection of the supply module 14, using a movement that is simple for the operator. In addition, the choice of a translational movement allows the volume of the space 16 intended to house the supply module 14 to be minimized. Finally, an operator can easily check that the supply module 14 is disconnected simply by visually checking the position of the module.

Such a switching device 2 therefore allows easy disconnection of the supply module 14 then allows it to be kept in the first disconnected position. The first disconnected position further corresponds to an only partial extraction of the supply module 14 from the housing 12, avoiding any loss of or damage to the supply module 14 during tests. Such a switching device 2 therefore makes it easier to carry out the electrical tests that require the supply module 14 to be disconnected.

In addition, the switching device 2 according to the invention prevents the supply module 14 from being extracted unless the cap 10 has been removed. Thus, the switching device 2 is safer in that it allows the supply module 14 to be extracted only by operators qualified to remove the cap 10.

As an alternative, the tab 30 is borne by a lateral wall of the housing space 16. The housing 12 therefore comprises a pull element (not depicted) able to force the deformation of the tab 30 towards the outside of the housing 12. The first opening 34, the second opening 36 and the slot 38 are then borne by the supply module 14. The rest of the switching device 2 is unchanged.

According to this alternative form, extraction of the supply module 14 from the housing 12 is permitted by the operator applying to the pull element a force that is directed towards the outside of the housing 12. This force allows the stop projection 28 to be disengaged from the end stop 40. This alternative form of embodiment offers the advantage of not requiring the use of an additional tool, such as a screwdriver, in order to be able to extract the supply module 14. In addition, there is no need to provide, in the supply module 14, a volume that allows the tab 30 to be deformed.

It will thus be appreciated that the trip 6 according to the invention allows the supply module 14 to be electrically disconnected easily and made safe while electrical tests are being carried out.

The invention claimed is:

1. A trip comprising:

a protective housing;

first electrical connection terminals; and a supply module comprising at least one transformer and second input and output terminals configured to be connected to the first electrical connection terminals according to a direction of connection, the supply module being configured to generate a supply voltage on the basis of an input voltage received between the second input terminals and to deliver the supply voltage between the second output terminals, wherein the supply module is moveable with respect to the protective housing, wherein the supply module further comprises a latch movable between a latched position and an unlatched position for latching the supply module in a connected position, and wherein the supply module comprises a projection to engage with the housing at a first opening contained within a planar wall of the housing at a first position where the first electric connection terminals and second input and output terminals are connected and engage with the housing at a second opening contained within the planar wall of the housing at a second position where the first electric connection terminals and second input and output terminals are disconnected.

2. The trip according to claim 1, wherein the supply module is translationally moveable with respect to the protective housing in the direction of connection.

3. The trip according to claim 1, wherein the supply module is removable with respect to the protective housing.

4. The trip according to claim 1, wherein the supply module is moveable in the direction of connection between the connected position in which the second terminals are connected to the first terminals and at least one disconnected position in which the second terminals are disconnected from the first electrical connection terminals.

5. The trip according to claim 1, wherein the supply module further comprises a retainer to keep the supply module in at least one disconnected position.

6. The trip according to claim 1, wherein the latch is moveable between the latched position in which the supply module is blocked in the connected position and the unlatched position allowing the supply module to move out of the connected position.

7. The trip according to claim 6, wherein the supply module further comprises control elements configured to move the latch between the latched position and the unlatched position.

8. The trip according to claim 7, wherein the control elements are secured to a grippable member configured to be grasped by an operator.

9. An electrical switching device, comprising the trip according to claim 1.

10. The electrical switching device according to claim 9, further comprising:

a base; and a protective cap fixed removably to the base, the cap, when fixed to the base, covering a stop so as to prevent access thereto from outside the cap.

11. The trip according to claim 1, wherein the projection engages with the housing at the first opening in the housing to maintain the supply module at the first position and engages with the housing at the second opening in the housing to maintain the supply module at the second position.

12. The trip according to claim 1, wherein the projection mates with the housing at each of the first and second openings.

13. A trip comprising:

a protective housing;

first electrical connection terminals; and a supply module comprising at least one transformer and second input and output terminals configured to be connected to the first electrical connection terminals according to a direction of connection, the supply module being configured to generate a supply voltage on the basis of an input voltage received between the second input terminals and to deliver the supply voltage between the second output terminals, wherein the supply module is moveable with respect to the protective housing, wherein the supply module further comprises a stop moveable between a stop position preventing the supply module from being withdrawn from the protective housing and a free position allowing the supply module to be withdrawn from the protective housing, wherein the supply module comprises a projection to engage with the housing at a first opening in the housing at a first position where the first electric connection terminals and second input and output terminals are connected and engage with the housing at a second opening in the housing at a second position where the first electric connection terminals and second input and output terminals are disconnected, and the stop is configured to engage with the second opening to prevent the supply module from being withdrawn from the protective housing.

14. The trip according to claim 13, wherein:

the projection is configured to engage with the first and second openings; and the supply module is movable between the first position and the second position.

15. The trip according to claim 14, comprising a latch configured to retain the supply module at the first position.

16. The trip according to claim 15, comprising an actuating stud configured to move the latch to an unlatched position.

17. The trip according to claim 13, comprising a latch configured to retain the supply module at the first position.

18. A trip comprising:

a protective housing;

first electrical connection terminals; and a supply module comprising at least one transformer and second input and output terminals configured to be connected to the first electrical connection terminals according to a direction of connection, the supply module being configured to generate a supply voltage on the basis of an input voltage received between the second input terminals and to deliver the supply voltage between the second output terminals, wherein the supply module is moveable with respect to the protective housing, wherein the supply module further comprises a latch movable between a latched position and an unlatched position for latching the supply module in a connected position, wherein the supply module comprises a projection to engage with the housing at a first opening in the housing at a first position where the first electric connection terminals and second input and output terminals are connected and engage with the housing at a second opening in the housing at a second position where the first electric connection terminals and second input and output terminals are disconnected, and wherein the projection engages with the housing at the first opening by clip fastening and engages with the housing at the second by clip fastening.

* * * * *